US008320782B2

(12) United States Patent
Zehentbauer et al.

(10) Patent No.: US 8,320,782 B2
(45) Date of Patent: Nov. 27, 2012

(54) ELECTROGRAPHIC PRINTING DEVICE COMPRISED OF PRINTING GROUPS WITH TONER RESERVOIRS OUTSIDE OF THE PRINTING GROUPS

(75) Inventors: Martin Zehentbauer, Gauting (DE); Bernd Hausmann, Maisach (DE)

(73) Assignee: Océ Printing Systems GmbH, Poing (DE)

( * ) Notice: Subject to any disclaimer, the term of this patent is extended or adjusted under 35 U.S.C. 154(b) by 867 days.

(21) Appl. No.: 12/297,279

(22) PCT Filed: Mar. 8, 2007

(86) PCT No.: PCT/EP2007/052165

§ 371 (c)(1),
(2), (4) Date: May 14, 2009

(87) PCT Pub. No.: WO2007/122039

PCT Pub. Date: Nov. 1, 2007

(65) Prior Publication Data

US 2009/0269093 A1 Oct. 29, 2009

(30) Foreign Application Priority Data

Apr. 18, 2006 (DE) ..... 10 2006 017 846

(51) Int. Cl.
*G03G 15/08* (2006.01)

(52) U.S. Cl. ..... 399/53

(58) Field of Classification Search ..... 399/53, 399/110, 119, 120, 90, 222, 224, 258
See application file for complete search history.

(56) References Cited

U.S. PATENT DOCUMENTS

| | | | | |
|---|---|---|---|---|
| 4,961,088 | A * | 10/1990 | Gilliland et al. | 399/25 |
| 5,329,340 | A | 7/1994 | Fukuchi et al. | |
| 6,181,885 | B1 | 1/2001 | Best et al. | |
| 6,366,742 | B1 | 4/2002 | Reihl et al. | |
| 2002/0110379 | A1 * | 8/2002 | Reihl et al. | 399/12 |
| 2003/0198487 | A1 | 10/2003 | Yanagisawa et al. | |

FOREIGN PATENT DOCUMENTS

| | | | |
|---|---|---|---|
| DE | 102 23 206 | | 12/2003 |
| DE | 103 28 600 | | 1/2005 |
| DE | 10 2004 039 678 | | 2/2006 |
| EP | 1 584 990 | | 10/2005 |
| JP | 07209926 | A * | 8/1995 |
| JP | 2007011196 | A * | 1/2007 |
| WO | WO 98/43136 | | 10/1998 |
| WO | WO 00/19278 | | 4/2000 |
| WO | WO 03/100527 | | 12/2003 |

* cited by examiner

*Primary Examiner* — Walter L Lindsay, Jr.
*Assistant Examiner* — Billy J Lactaoen
(74) *Attorney, Agent, or Firm* — Schiff Hardin LLP

(57) ABSTRACT

In an electrographic printing device a plurality of printing groups each have a respective plurality of developer stations. A plurality of toner reservoirs are each connected via a respective toner transport channel with one or more of the developer stations. Each of the toner reservoirs outside of the printing groups is stored in a respective toner transport unit. Each of the toner reservoirs is provided with a first circuit having a memory in which is stored at least a color filled into the respective toner reservoir. A respective second circuit with a memory is associated with each of the toner transport units. These memories have stored therein at least the respective toner color filled into the respective stored toner reservoir. A respective third circuit with a memory is provided for each developer station, the respective third circuit memory having stored therein at least a toner color filled into the respective developer station.

38 Claims, 6 Drawing Sheets

ELECTROGRAPHIC PRINTING DEVICE COMPRISED OF PRINTING GROUPS WITH TONER RESERVOIRS OUTSIDE OF THE PRINTING GROUPS

BACKGROUND

The filling of consumables from a container into a receptacle is of particular importance in electrographic printing devices. Given this use case, it is necessary to continually introduce toner as a consumable into at least one data stream as a receptacle. The function of such a printing device is known from WO 00/19278, for example. The addition of toner into the developer stations is likewise described there; WO 00/19278 is expressly referenced, and its content is additionally incorporated into the disclosure. It is described how a container with toner can be connected with a developer station in order to fill new toner into the developer station. It is additionally described how the content of the container for the toner can, for example, be recorded in a transponder in order to ensure that only the correct toner is filled into the developer station. The toner transport connection between the developer station and the toner container is established via a toner transport channel on which an electrical coding conductor is permanently arranged, via which an electrical connection exists between the toner container and the developer station. Via this coding conductor it can be ensured that the toner transport channel is connected to the associated developer station and the correct toner container.

A toner reservoir with which toner can be securely transported and from which toner can be filled into a developer station is described in DE 10 2004 039 678.

SUMMARY

It is an object to ensure the toner supply from multiple toner reservoirs in an electrographic printing device that can also have multiple printing groups with respective multiple developer stations.

In an electrographic printing device a plurality of printing groups each have a respective plurality of developer stations. A plurality of toner reservoirs are each connected via a respective toner transport channel with one or more of the developer stations. Each of the toner reservoirs outside of the printing groups is stored in a respective toner transport unit. Each of the toner reservoirs is provided with a first circuit having a memory in which is stored at least a color filled into the respective toner reservoir. A respective second circuit with a memory is associated with each of the toner transport units. These memories have stored therein at least the respective toner color filled into the respective stored toner reservoir. A respective third circuit with a memory is provided for each developer station, the respective third circuit memory having stored therein at least a toner color filled into the respective developer station.

DESCRIPTION OF THE PREFERRED EMBODIMENT

Figure 1:
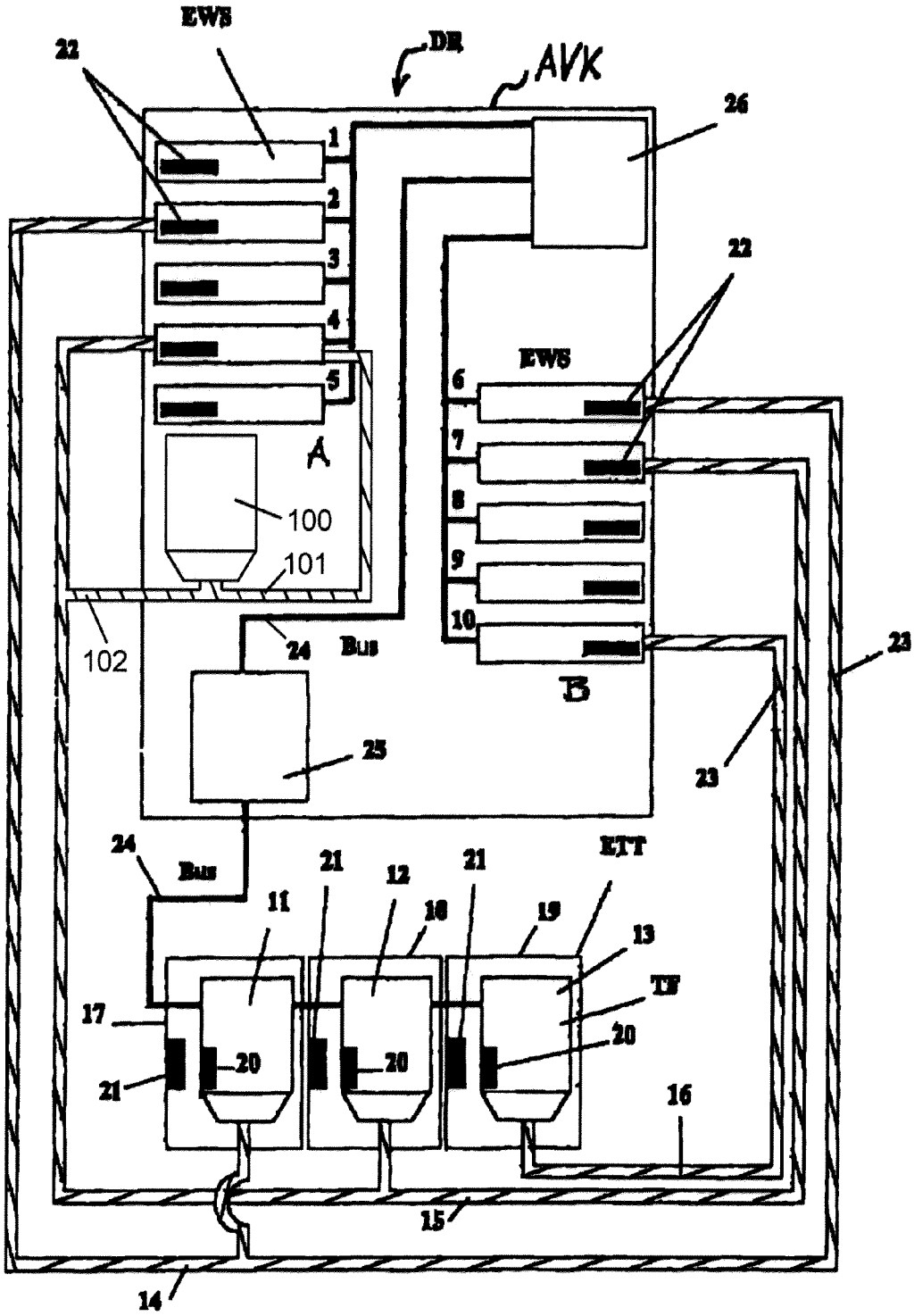
FIG. 1 illustrates a presentation of the toner supply using external toner transport units in an electrographic printing device.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

The electrographic printing device has at least one printing group that contains at least one developer station via which charge images generated on an intermediate carrier are inked with toner. At least one toner reservoir that is connected with the developer station via a toner transport channel operating system is arranged outside of the printing group for addition of the toner into the developer station.

The preferred embodiment is based on the realization that electrographic printing devices are normally designed modularly, wherein individual modules can be designed as aggregates that form a mechanical, electrical and/or control unit. A printing group can thereby be such a module or unit, and the toner reservoir arranged outside of the printing group can, according to an advantageous embodiment of the invention, in particular be provided mechanically independent of the printing group, and furthermore—independent of the printing group—can be positioned or mounted inside or also outside of the printing device. It can in particular be arranged at a distinct (relative to the dimensions of the printing group) spatial distance from the printing group, or even from the printing device, and/or be mechanically connected with the printing group only via the toner transport channel.

The preferred embodiment is particularly advantageous when a plurality of printing groups are provided with a respective plurality of developer stations. The toner addition can then occur via toner reservoirs arranged outside of the printing groups, which toner reservoirs are respectively connected via a toner transport channel with a developer station or multiple developer stations that can be associated with one or more printing groups.

However, for adding toner into the developer stations, it is also possible to provide toner reservoirs within the printing groups in addition to the toner reservoirs arranged outside the respective printing group, which toner reservoirs within the printing groups are connected with the developer stations via an internal toner transport channel. The toner reservoirs can, however, also be arranged outside the printing device.

The developer stations of the printing groups can additionally be designed such that they can also be manually supplied with toner, for example via manual refilling of a toner store integrated into the developer station.

The individual toner transport channel can be designed as a suction channel through which toner can be sucked into the connected developer station.

It is particularly appropriate when the toner reservoirs arranged outside of the printing groups are stored in a toner transport unit so that they can easily be moved.

In order to be able to determine the color contained in the toner reservoirs, these can be provided with a first circuit possessing a memory in which is stored at least the color filled into the associated toner reservoir. The color information can thereby be stored in a transponder arranged on the toner reservoir.

A second circuit with a memory in which at least the color filled into the associated toner reservoir is stored can respectively be correspondingly associated with the toner transport units. The same applies for the developer stations; here a third circuit with a memory in which at least the filled color is stored can be provided per developer station. In order to be able to exchange information (for example information about the color) between the circuits of the developer stations and the toner reservoirs, the electrical connection lines (ping lines) can be associated with the toner transport channels. These electrical connection lines can be wound around the associated toner transport channels. The connection lines (ping lines) can, however, also only be used to query which developer station is connected with which toner transport unit, and the toner reservoir arranged therein.

To coordinate the cooperation of the components of the toner supply (developer stations, toner reservoirs, toner transport units), a main control module can be provided that controls the workflows in the printing groups and thereby in particular queries the colors respectively contained in the developer stations and toner reservoirs. Since the color is also stored in the toner transport unit, this can likewise be queried. For this, the main control module is connected via a bus with a third circuit of the respective developer stations of the printing groups to monitor the developer stations. A sub-control module can additionally be provided that is connected via a bus with the first circuit and second circuit and the main control module, which sub-control module detects at least the colors stored in the circuits of the toner transport units and toner reservoirs and transmits these to the main control module. From the information supplied by the developer stations and the sub-control module, the main control module can determine which toner reservoir is connected with which developer station. If this connection is queried via the ping line, the result of the query is passed to the main control module. The main control module then establishes whether the connections are correct, and compares the toner colors of the developer stations and of the toner reservoirs; and the main control module receives the information about the toner colors via the bus.

The main control module can additionally detect the equipment status of the printing groups and toner reservoirs with all possible combinations of connections of toner reservoirs with developer stations. The main control module can then display the equipment status to the operator on a control panel.

Using the color information stored in the circuits of the developer stations and toner reservoirs or toner transport units, the main control module can thereby establish whether the respective developer station is connected with a toner reservoir that contains the correct color. It is then advantageous if the toner transport unit registers its color upon insertion of a toner reservoir and communicates this color to the sub-control module, which relays this information to the main control module. The main control module can display a color change on the control panel as information for the operator. This is advantageous since the operator can take corrective measures if an unwanted color change has occurred. In order to prevent that, although the stored color of the toner in the developer station and in the associated toner reservoir agree, the connecting toner transport channel has not been changed or cleaned given a color change, after a color change in the toner reservoir the operator can be prompted by the main control module (via the control panel) to first change or clean the components of the toner transport channel that contacted the previously used color, in order to subsequently be able to store the new color in the second circuit of the toner transport unit.

The main control module thus generates an error signal when, given a color change within a toner transport unit or use of a toner reservoir with another color, the components of the toner transport channel between toner reservoir and developer station via which the preceding color has been transported have not been exchanged or cleaned. It is therefore prevented that the toner of other colors can be contaminated by the color residues in these components. In this case it is particularly important to clean or exchange the toner transport channel. The error message indicates that the color of the toner that is stored in the toner transport unit deviates from the color contained in the toner reservoir. It is then to be assumed that the color change was unintentional or has been incompletely performed. If the toner transport channels are likewise provided with an electrical circuit with memory, the color information can be stored there, and via querying it can be established whether the toner transport channel has been cleaned or exchanged given a color change.

The power supply of the circuits in the toner transport units appropriately occurs via the bus that connects the toner transport units with the main control module. The first circuits (insofar as they are realized as transponders) require no separate power supply since the second circuit communicates with the transponder.

For example, if the printing device is activated, it is appropriate to check the components that are important in the development of the toner images. In a first step, the developer stations can thereupon be checked as to

- which developer station is used in the respective printing group,
- which toner color is contained in the respective developer station,
- in which manner the respective developer station is supplied with toner.

When inspecting the toner supply it can be checked whether the toner is added via a toner transport unit arranged outside the respective printing group or its toner reservoir or via a toner reservoir arranged in the respective printing group, or whether the toner addition occurs manually.

In an additional step, the toner transport units can thereupon be checked as to

- how many toner transport units are arranged in the printing device,
- which toner colors the toner reservoirs stored in the transport units possess,
- whether the toner transport units are functional,
- which toner color is stored in the toner transport unit; it can thereby be established which toner color a toner reservoir that is used in the toner transport unit should contain, since only toner from such toner reservoirs may be conveyed into the associated developer station.

Furthermore, the functionality of the toner transport units can be checked as to whether

- a toner reservoir is inserted,
- the toner transport channel is operationally connected.

The connection between toner transport unit and respective developer station can additionally be interrogated via the respective connection line and can thereby be inspected.

Finally, it can be checked whether a toner reservoir is present whether the content of the toner reservoir is readable what toner color is located in the toner reservoir whether the toner reservoir is empty.

The main control module thereby detects the configuration of developer stations, toner transport units and toner reservoirs and establishes the current situation of the toner supply. The current configuration can be presented on the control panel to inform the operator.

If deviations of the current configuration from the desired configuration and of the current function from the desired function should be established by the main control module in this inspection process, this will transmit an error message or graphically display this on the control panel, for example.

It is particularly important that the main control module checks whether the toner colors in the associated developer stations, toner reservoirs, toner transport units coincide, wherein first a check of the developer station and of the toner transport unit is to be conducted to this effect, and then the check of the toner transport unit and of the toner reservoir. It is advantageous when the main control module prevents the print operation if the toner colors of the associated developer station, toner transport unit or toner reservoir do not coincide.

Furthermore, the main control module should interrogate the respective developer station (and in fact its circuit) to the effect of how its toner supply is executed (manually, via negative pressure), and adjust the toner supply to the developer station dependent on the result of the toner feed. Given a change of the toner supply of the respective developer station, the information stored in its third circuit should likewise be correspondingly set by the main control module. The manual adjustment can be conducted by an operator.

To add toner into the developer stations, toner reservoirs are thus provided that are connected with the developer stations via a toner transport channel. To supply the developer stations with toner, a toner transport device controlled by a supply manager is provided that transports toner from the toner reservoirs into the developer stations. If toner is required, the developer stations output toner requests to the supply manager, which coordinates these and then allocates the supply permission to the developer stations in clock periods. The clock periods can have the same duration.

The prompt supply of the plurality of developer stations of such a printing device with toner is of great importance to their operation. According to the preferred embodiment, a suction device can be provided as a toner transport device for these, which suction device transports toner from the toner reservoirs into the developer stations via negative pressure and is controlled by a suction clock manager as a supply manager. If toner is required, the developer stations emit suction requests as toner requests to the suction clock manager; the suction clock manager coordinates the suction requirements of the developer stations and allocates the suction permission to the developer stations in suction clock periods that can be temporally delimited. The suction clock manager can be integrated into a main control unit of the printing device as control software.

It is particularly advantageous when the suction clock manager distributes the suction clock periods allocated to the developer stations to a the developer stations such that a single suction device is sufficient to supply said the developer stations of the printing groups. The suction clock manager can thereby simultaneously allocate the suction clock period to only one developer station. Given multiple printing groups, the suction clock manager can simultaneously allocate the suction clock period to only one developer station per printing group.

It is appropriate when the suction clock manager allocates the suction clock period to only one developer station that does not simultaneously convey toner (for example to develop charge images; transport cycle). However, the suction clock manager allocates no suction clock period to a developer station when the suction permission for the same toner reservoir has already been allocated to a developer station.

Furthermore, the suction clock manager can be realized such that it withdraws the suction permission from a developer station (forced pause) after a predetermined number of suction clock periods have been supplied to a developer station; for example, it can withdraw the suction permission from a developer station after two suction clock periods. During a forced pause, the suction manager can grant the suction permission to a different developer station outputting a suction request.

To coordinate the suction requests of the developer stations, these can be stored in a first FIFO memory in the order of their arrival at the suction clock manager. The suction clock manager then examines the suction requirements, in the order of their storage in the first FIFO memory, as to whether a suction permission can be allocated to them. This is the case when the suction permission has not been allocated to any other developer station, and when the developer station to be checked is not transporting toner (transport cycle).

If the developer station to be checked is presently transporting toner, no suction permission is granted. After the end of the transport cycles of the developer station to be checked, instead of this its suction request can be stored in a second FIFO memory. Given the check of the suction permission of the additional suction requests of other developer stations that are stored in the first FIFO memory, it is then first inspected whether a suction request of a developer station stored in the second FIFO memory exists, and for this case this suction request is granted before the suction request of the developer stations stored in the first FIFO memory.

It is advantageous if, given a developer station to which a suction permission has been granted, the transport function is blocked until the suction cycle is ended.

The following points of view can be taken into account in the prioritization of the suction requests from different developer stations in the granting of a suction permission:

the future toner requirement of the developer stations; this can be determined using the future charge images to be developed, for example;

the toner concentration in the developer station;

the development of charge images is paramount in the operation of a printing group.

The priority in the allocation of a suction permission can be provided according to a rigid criterion. For example, the criterion can be present after a predetermined number of transport clock periods in a developer station have elapsed.

In spite of the presence of an above criterion in a developer station, the allocation of a suction permission to a different developer station can occur when the suction request of this developer station has higher priority for the print operation. For this, before allocating a suction permission to a developer station, the priorities of all developer stations presenting a suction request can be examined, and the suction permission can be granted to the developer station that has the greatest importance for maintaining the print operation.

The drawings show a preferred embodiment.

Arising from FIG. 1 is the presentation of a toner supply in an electrographic printing device DR whose other (in particular electrical and mechanical) design (for example paper transport device, transfer printing station, fixing unit, device controller) is assumed to be known and can be learned from WO 00/19278, the content of which is incorporated into the disclosure. The printing device DR as an example has two printing groups A and B that respectively contain developer stations EWS. For example, the printing group A has the developer stations 1 through 5 and the printing group B has the developer stations 6 through 10. The other electromechanical or physical design of the printing groups A and B is assumed to be known. The printing device DR is at least largely externally shielded (mechanically and possibly electrostatically) by an external casing AVK attached to it.

Of the toner supply, the developer stations 1 through 10 are shown that serve in a known manner for development of charge images that, for example, have been generated on a photoconductor as an intermediate carrier. Developer that has at least toner that is used to ink the charge images is respectively contained in the developer stations 1 through 10. The toner can be of different colors in order to be able to generate color images. Toner that must be added during operation is consumed in the development of the charge images. For this purpose, three toner reservoirs TF 11, 12, 13 are provided in FIG. 1, which toner reservoirs TF 11, 12, 13 are set up outside of the printing device DR or its external casing AVK and are connected via toner transport channels 14, 15, 16 with developer stations. Toner can be transported into the developer stations via these toner transport channels 14, 15, 16. For this, for example, a negative pressure system as is described in WO 00/19278 can be provided, and this sucks the toner into the associated developer stations via negative pressure in the toner transport channels; in this case, the toner transport channels are suction channels. They can be designed as hoses made from flexible material, for example.

The toner reservoirs 11-13 in FIG. 1 are respectively arranged in toner transport units ETT 17 through 19 in order to able to transport these more easily. The individual toner transport unit 17 through 19 must then have a connection for the toner transport channel that is connected with the respective toner reservoir.

In the exemplary embodiment of FIG. 1, the toner reservoir 11 is connected via the toner transport channel 14 with the developer stations 2 and 6; the toner reservoir 12 is connected via the toner transport channel 15 with the developer stations 4 and 7; to the contrary, the toner reservoir 13 is connected via the toner transport channel 16 with only the developer station 10. The developer stations that are not connected to external toner reservoirs are internally supplied with toner, for example via internal toner reservoirs that are connected via toner transport channels with the developer station, or the toner is manually added in that toner is filled from a container (corresponding to DE 10 2004 039 678) into the developer station by the operator. Three possibilities of toner supply of the developer stations EWS thus exist:

- the supply via internally arranged toner reservoirs,
- the supply via externally arranged toner reservoirs (outside of the printing groups or the printing device) and
- manual supply.

In order to be able to monitor the toner supply of the printing groups A, B, for example in order to ensure that toner is promptly added into the developer stations EWS and that the correct toner is filled into the developer stations, each toner reservoir 11 through 13 is respectively provided with a first circuit 20 containing a memory; each toner transport unit 17 through 19 is respectively provided with a second circuit 21 containing a second memory; and the developer stations 1 through 10 are respectively provided with a third circuit having a memory. The memory of the first circuit 20 can, for example, be a transponder arranged on the toner reservoir (corresponding to WO 00/19278).

The circuits contain at least information about the toner contained in the components of the toner supply (developer stations, toner reservoirs, toner transport units) and its color. In particular, the circuits 21, 22 can additionally contain a software control program and a microprocessor. The information exchange between the toner reservoirs or the toner transport units and the developer stations EQS can occur via electrical connection lines 23 (ping line) that connect the toner reservoirs TF or toner transport units ETT with the associated developer stations EWS. For example, these connection lines 23 can be wound around the toner transport channels; in FIG. 1 this is represented by angled lines on the toner transport channels 14 through 16. Via these connection lines 23, the information that is contained in the first and second circuits can be supplied to the developer stations. For example, the printing device DR can thereby establish which toner transport unit or toner reservoir is connected with which developer station, and thereby can establish whether the toner reservoir is connected with the correct developer station with regard to the color. The connection line can, however, also be used only in order to establish whether a toner reservoir or a toner transport unit is connected with the associated developer station EWS via a toner transport channel.

The circuits 20, 21 of the toner reservoirs TF or of the toner transport units ETT can furthermore be connected via a bus 24 with a sub-control module that queries and collects the information from the first and second circuits 20, 21. The sub-control module 25 is connected with a main control module 26 that is additionally connected with the third circuits 22 of the developer stations EWS. The main control module 26 thus receives information about the state of the developer stations EWS and the toner reservoirs TF and toner transport units ETT. From this information, it can control the printing device DR, for example output error messages when the toner supply of the developer stations is interrupted. It is advantageous if the main control module displaces the status of the toner supply on a control panel BDF for the operator, for example with a graphical menu.

Figure 2:
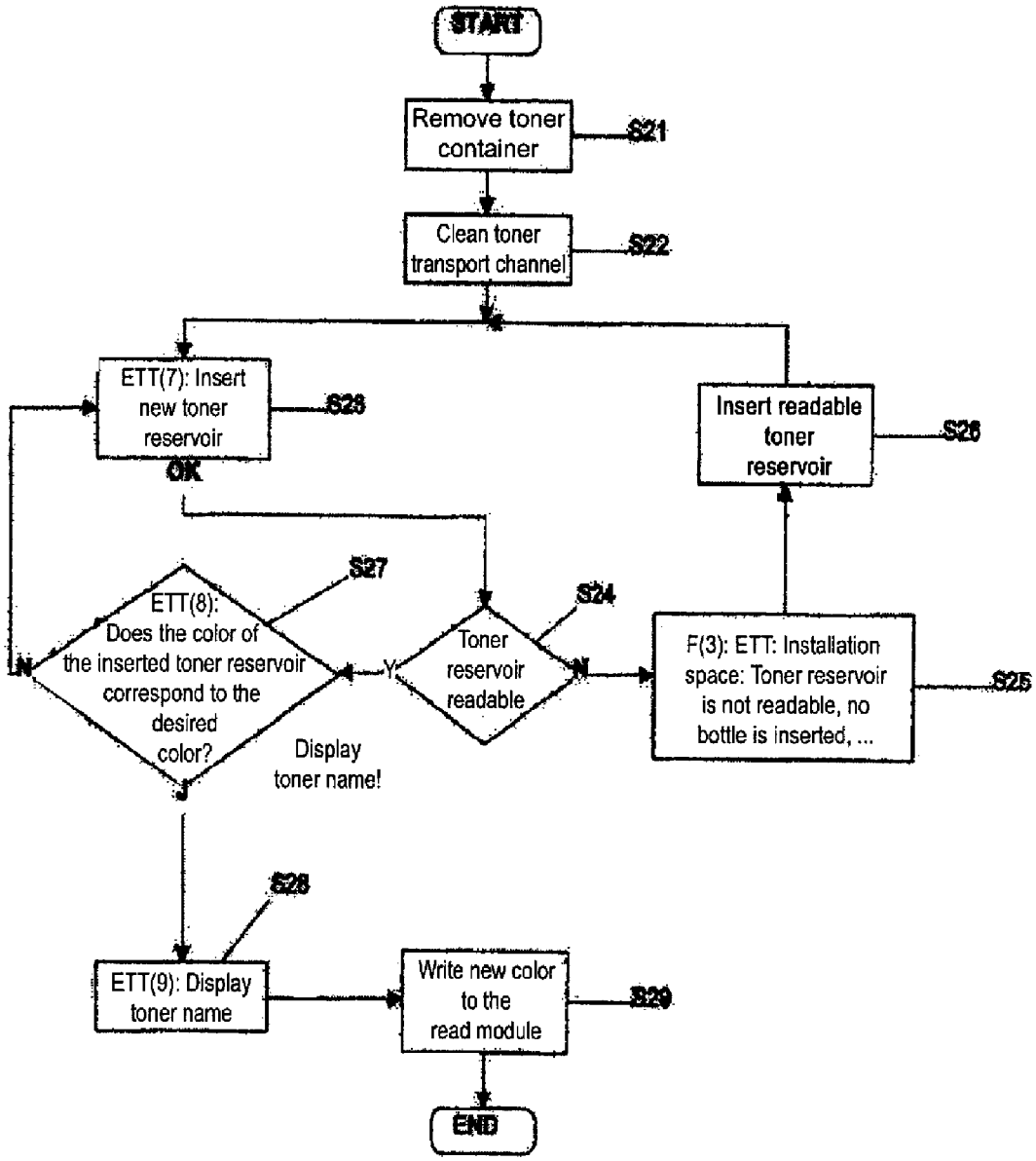
FIG. 2 shows a workflow diagram that depicts the exchange of a toner reservoir in the toner transport unit.

The information exchange between the toner reservoirs TF and the developer stations EWS is particularly advantageous when a new toner reservoir is inserted into a toner transport unit. The color of the new toner can thereby be changed in comparison to the previously used toner (old toner). In order to prevent that the new toner is contaminated by residues of the old toner, all components of the transport path to the developer station that were used by the old toner must be exchanged or cleaned. This particularly applies for the toner transport channel and the connection components for the toner transport channel to the toner reservoir. If this exchange or cleaning has not been executed, the new toner may not be transported to the developer station. For this it is necessary to detect when the toner color of a toner reservoir that is set in a toner transport unit deviates from the color stored in the second circuit. If this should be the case, the toner transport function is blocked. A method used for this can be learned from FIG. 2. In a step S21, the previously used toner reservoir TF is removed from the toner transport unit ETT. In Step S22, the operator is requested to clean the toner transport channel between the toner transport unit ETT and the developer station. In Step S23, a new toner reservoir RF is subsequently inserted into the toner transport unit ETT. In Step S24, it is checked whether the first circuit of the toner reservoir TF is readable. If this is not the case, in Step S25 a corresponding message is output, and in Step S26 the operator is requested to insert a readable toner reservoir TF into the toner transport unit. If Step S24 yields that the toner reservoir TF is readable, in Step S27 it is examined whether the color of the toner in the used toner reservoir TF corresponds to the desired color. If this is not the case, Step S23 is repeated. However, if this is the case, the toner color can be output on the control panel (Step S28). The toner color is finally written to the second circuit (Step S29). The new toner color can only be written to the second circuit of the toner transport unit if the toner transport channel has previously been cleaned. Whether this has occurred can thus be established by interrogating the second circuit, since then the toner color in the circuits of the developer station EWS, the toner reservoir TF and the toner transport unit ETT coincides.

The toner transport unit ETT can be realized as a transport container into which the toner reservoir is inserted, such that toner can be drawn from its outlet opening into the toner transport channel attached to the toner transport unit via a connection arranged in the toner transport unit. The toner reservoir and the connection into the toner transport unit can be executed corresponding to DE 10 2004 039 678. This publication is also herewith incorporated by reference into the present specification.

The configuration of the components of the toner supply, and in particular their function, are explained in further detail hereafter:

A selectable number of toner transport units ETT (for example 9 toner transport units) is located outside of the printing groups in the printing device DR. These are connected by means of the bus 24 to the sub-control module 25 that is arranged in the printing device DR. The power supply (the power supply unit is located in the printing device DR) and the data transfer are realized via the bus 24. The toner transport units ETT have the task of supplying the developer stations EWS with toner. For this purpose, they are connected via a toner transport channel 14-16 (for example a toner suction hose) with the associated developer station. What is known as the ping line 23 (connection line) is wound around the toner transport channel in addition to a ground line. Current pulses that are received by the associated developer station are sent via the ping line 23. With these it can be determined which toner transport unit is connected with which developer station. In the printing device DR, the developer stations EWS and the sub-control module 25 for the toner transport units ETT are connected via the bus 24 with the main control module 26, whereby the "information loop" is closed.

The ping signal via the connection lines 23 can be realized via:

- a simple pulse or
- a complex series of changing electrical signals. The modification possibilities exist in the length, the intensity, the polarity and the temporal change of the signals.

These variations can be used in order to be able to receive unambiguous connections and not run the risk of accepting false connections (due to interfering pulses, for example).

A toner transport unit ETT connected to the sub-control module 25 can be connected with

- no developer station EWS,
- one developer station EWS or
- multiple (for example two) developer stations EWS.

In addition to the toner reservoir TF (first circuit 20, transponder) and the developer station EWS (third circuit 22), the toner color or the toner name is also stored in a second circuit at the toner transport unit ETT (second circuit 21). This information is important since modifications to the toner supply, and therefore errors and contaminations, must be detected.

The current situation of the toner supply (the components: developer station EWS, toner transport unit ETT, toner reservoir TF) is registered and processed in the printing device DR. Corresponding to the detected configuration of the components, indicators (for example in menus), warnings, errors are displayed in the control panel BDF. For example, this proceeds according to the following:

- The current situation of the components, including the present toner transport channels, is graphically shown in menus.
- The color agreements are checked. The toner color of the developer station, of the toner transport unit and of the toner reservoir must thereby correspond in order to ensure a proper operation.
- Two different loops are checked in the inspection of the color agreement:
- Loop A: developer station EWS—toner transport unit ETT
- Loop B: toner transport unit ETT—toner reservoir TF.

In the event of error, different messages are output and displayed on the control panel, corresponding to the inspection of both loops.

Due to the various possibilities that indicate how the individual developer stations EWS can be supplied with toner, it is important that the printing device DR knows the configuration of the components with regard to the toner supply. An interrogation method via which the given toner supply system is detected and corresponding error messages are output given occurring errors is available to the printing device DR, the main control module 26 for this.

Figure 3:
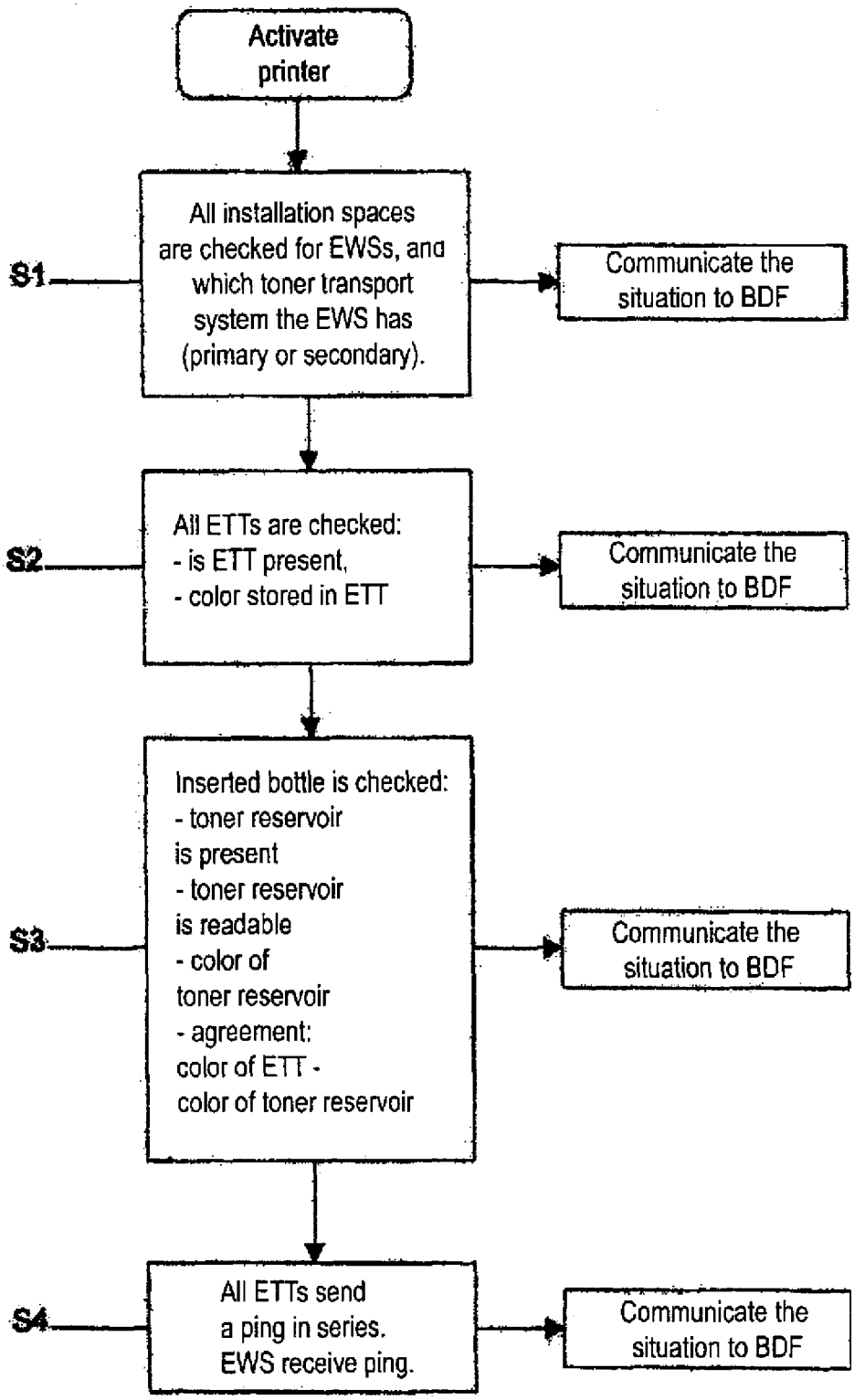
FIG. 3 illustrates a diagram that presents the workflow of the acceptance of the current toner supply system as controlled by the main control module.

Upon activation of the printing device DR, the main control module 26 starts a workflow (FIG. 3) that records the configuration of the printing device DR with regard to the toner supply. The data of the following components of the toner supply are thereby registered:

- Developer stations (for all developer stations EWS)→EWS test (Step S1):
  - Which developer stations are present?
  - Which toner colors are filled into the respective developer stations?
  - How are the developer stations supplied with toner (by means of suction function or manually)?
- Toner transport units (for all toner transport units ETT)→ETT test (Step S2):
  - How many toner transport units are present?
  - Which toner colors are associated with the toner transport units?
  - Is there an error at the toner transport units (for example, no toner reservoir is inserted)?
- Toner reservoirs (for all toner reservoirs TF)→TF test (Step S3):
  - Is a toner reservoir inserted into the associated toner transport unit ETT?
  - Is the toner reservoir readable?
  - Which toner color is located in the toner reservoir?
  - Is the toner reservoir empty?
- Connect developer station EWS→toner transport unit ETT (Step S4)"
  - The connections between the toner transport units ETT and the developer stations EWS are interrogated by means of signal "ping signal".

The result is displayed on the control panel after each step S.

Figure 4:
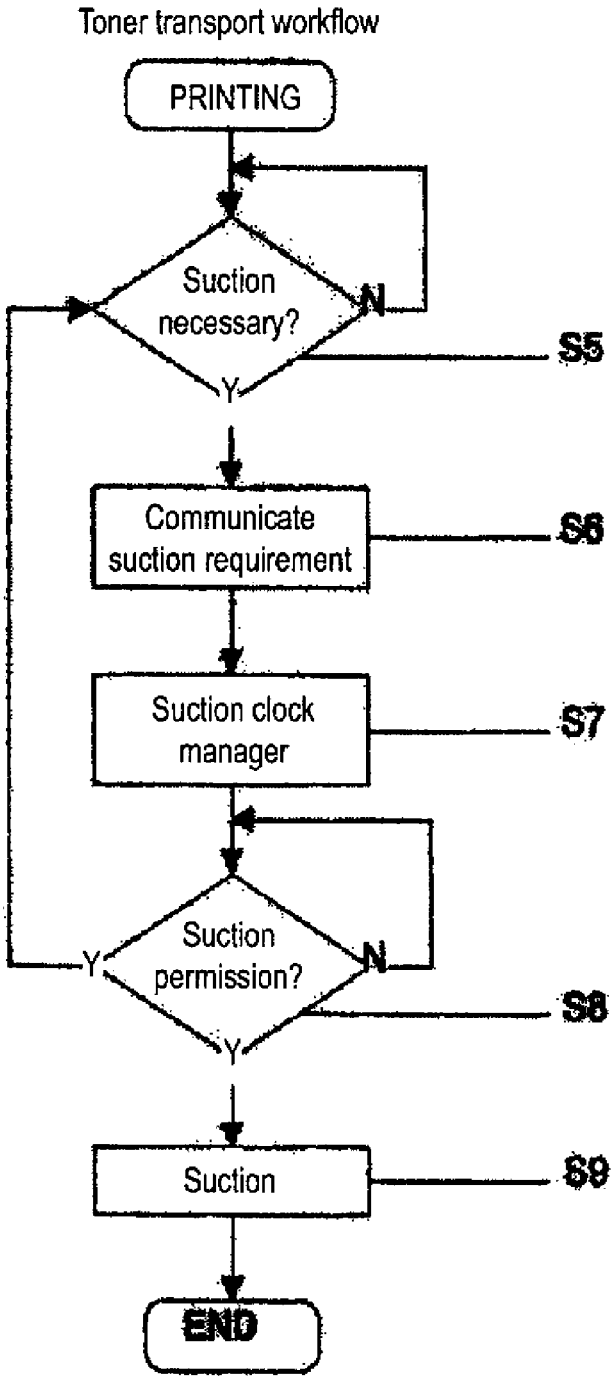
FIG. 4 shows the principle representation of the workflow of the suction process.

Using FIG. 4 through 6, in the following it is now explained how the supply of the developer stations with toner can be optimally implemented:

A workflow diagram that shows the mode of operation of a suction clock manager that is integrated into the main control module results from FIG. 4. In the printing operation of, for example, two printing groups A, B, the suction clock manager is responsible for coordinating the suction requests of the developer stations EWS. The suction clock manager is active when a toner requirement has been communicated by one or more developer stations EWS (suction request Step S5 and S6). The developer stations EWS transmit their suction requests to the suction clock manager (Step S7). The suction clock manager coordinates the suction requirements and grants suction permission to a developer station (Step S8). The toner is supplied to the data sets in suction clock periods (Step S9).

Figure 5:
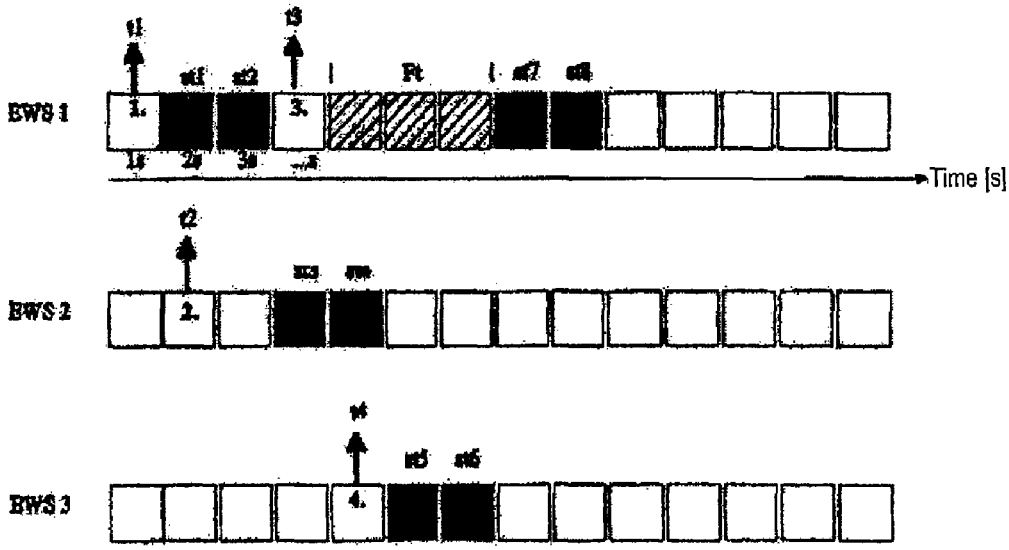
FIG. 5 illustrates a time diagram that presents the temporal position of the processing of the suction requests from three developer stations.

In a time diagram, FIG. 5 shows the allocation of the suction permission to, for example, three developer stations EWS1 through EWS3 by the suction clock manager. The developer stations EWS1 (first line) communicate a toner requirement in a first clock (time duration of one second, for example). The suction clock manager grants the developer station EWS1 suction permission for two suction clock periods st1 and st2 (filled in with black), for example. During the suction clock period st1, the developer station EWS2 (line 2) poses a suction request t2. The developer station EWS2 must wait until the suction clocks st1 and st2 for the developer station EWS1 are over. The suction clock manager now grants suction permission to the developer station EWS2 for two suction clock periods st3 and st4. If the developer station EWS1 now outputs the next suction request t3, this must first wait for the suction permission. In the wait time, the developer station EWS1 can transport toner for development of charge images (dashed clock Ft). In the intervening time, the developer station EWS3 has posed a suction request t4. This is given preference over the suction request ts3 since the developer station EWS3 has not yet been supplied with toner and the developer station EWS1 is still busy transporting toner. In suction clock periods st5 and st6, the developer station EWS3 receives suction permission. After the end of the suction clock periods st5 and st6, the suction request t3 of the developer station EWS1 is tended to by the suction clock manager, and this grants the suction permission for the suction clock periods st7, st8 since no additional suction requests from other developer stations are present.

Clock periods of 1 second have respectively been selected as an example in FIG. 5. Naturally, the clock periods can also have another duration or be of different durations. It is likewise possible that suction permission is granted over a greater number of suction clock periods. Furthermore, from FIG. 5 it can be learned that the suction permission is not granted in the order of the arrival of the suction requests. Rather, it is sought to handle the developer stations corresponding to their toner requirement. The developer station EWS3 is correspondingly granted suction permission earlier than the developer station EWS1, although this posed a suction request earlier.

The suction requests of the developer stations can thus be granted priorities that are selected so that the operation of the printing device is optimized. The following factors can be taken into account in the prioritization:

The expected toner requirement of the individual developer stations; this can be determined from the data to be determined.

The fill level of the toner container in the respective developer station.

A change of the toner container in the developer station.

A toner transport problem in the developer station has been corrected.

The toner concentration in a developer station has dropped.

In addition to the prioritization of the allocation of the suction clock periods to the developer stations, the transport clock periods can also be prioritized, and this can be taken into account in the allocation of the suction clock periods to the developer stations. Which process (suction or transport) is more important in the respective developer station is thereby established.

The priorities can also be assigned according to rigid rules. For example, the suction clock manager assigns suction permission to a developer station if this has not been supplied with toner for 10 transport clock periods, for example. The priority assignment can also occur dynamically, however. The individual factors influencing the toner supply are thereby not considered in isolation; rather, an evaluation of these factors in all developer stations occurs. For example, if one developer station has not been supplied with toner for 10 transport cycles, it is possible that this developer station does not receive the highest priority (deviating from the example above) since, for example, the toner concentration of another developer station has dropped too significantly and an error message is therefore impending.

Figure 6:
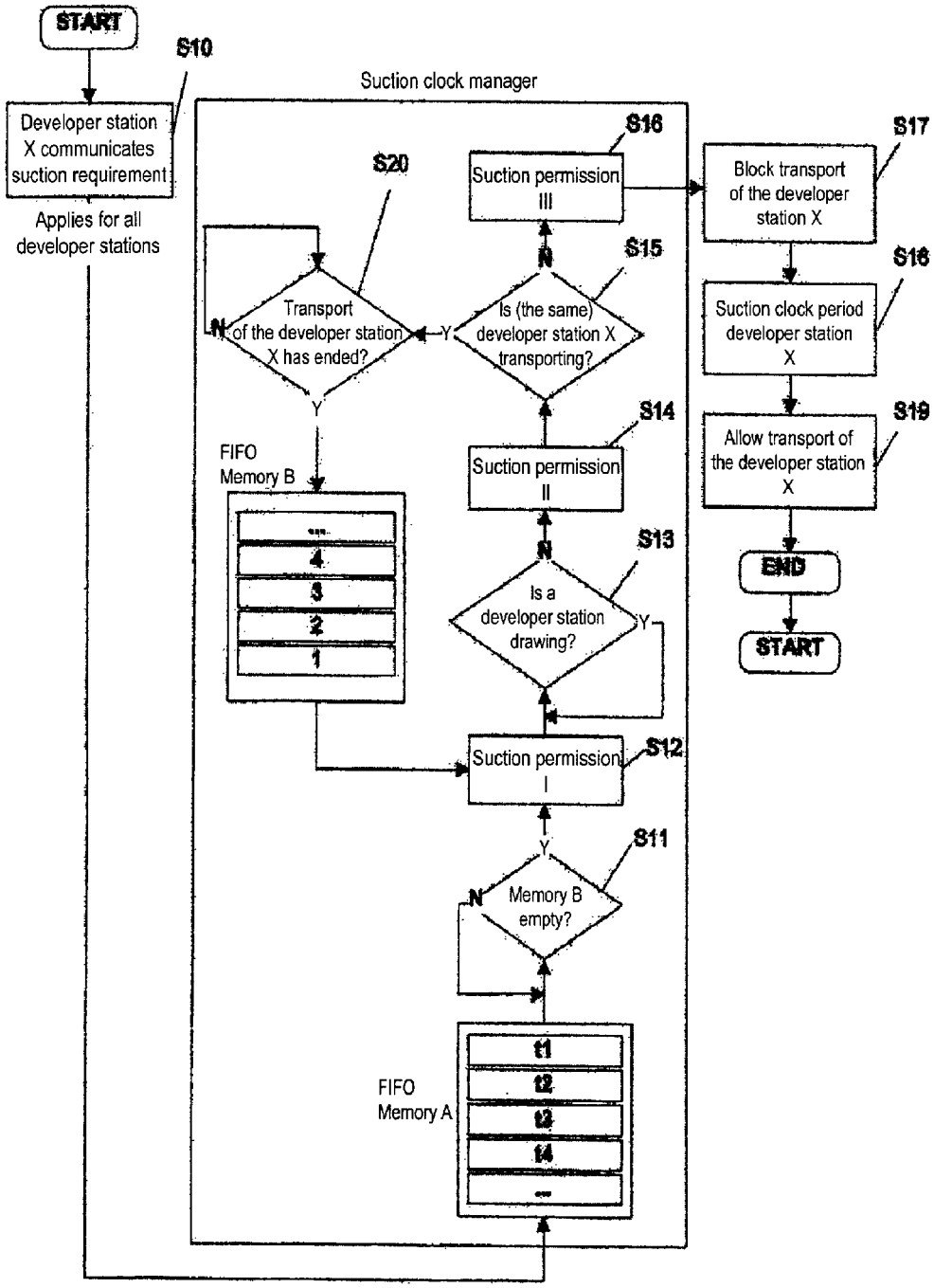
FIG. 6 is a workflow diagram that presents the processing of suction requests from multiple developer stations as an example.

The mode of operation of the suction clock manager is explained further using FIG. 6. The developer stations (for example the developer station X) communicate a suction request t1 (Step S10). The suction requests of the developer stations are stored in a FIFO memory A in the order of their arrival at the suction clock manager. The first suction request t1 stored in the FIFO memory A is subsequently processed; it is established whether a suction request is contained in a second FIFO memory B (Step S11). It is initially assumed that this is not the case. The suction request t1 then receives a first suction pre-approval (Step S12). In a next step S13, it is established whether another developer station is drawing toner; as long as this is the case, the suction request t1 cannot be handled. If this is not the case, the suction request t1 receives a second suction pre-approval (Step S14). In the following step S15 it is checked whether the developer station with the suction request t1 is presently transporting toner. If this is not the case, the suction request t1 is allowed by the suction clock manager (Step S16) and the corresponding developer station X receives the suction permission. The transport of toner is now blocked for the developer station X (Step S17), and it can draw toner from a toner reservoir in suction clock periods (Step S18). The toner transport block is lifted again (Step S19) after expiration of the suction clock periods.

If it is established in Step S15 that the developer station X is presently transporting toner, in a step S20 it is waited until the transport cycles have ended, and then the suction request t1 is stored in the FIFO memory B.

If, in Step S11, a suction request from the FIFO memory B is present during the further processing of the suction requests from the FIFO memory A, this request from the FIFO memory B is given preference (Step S12) and the suction request from the FIFO memory A must wait. A suction request from the FIFO memory A can only be handled again when all suction requests from the FIFO memory B have been processed.

FIG. 6 shows an example of how the suction clock manager can execute the suction requests of multiple developer stations. However, the preferred embodiment is not limited to this exemplary embodiment. Rather, the mode of operation of the suction clock manager can be adapted to the respective design of the printing device and to its desired operational mode.

The preferred embodiment is suitable for application in diverse printing apparatus types, in particular in electrographic printing devices, among which are (for example) electrophotographic printing apparatuses, magnetographic printing apparatuses and ionographic printing apparatuses; however, it is not limited to these.

Although a preferred exemplary embodiment has been shown and described in detail in the drawings and in the preceding specification, it should be viewed as merely exemplary and not as limiting the invention. It is noted that only the preferred exemplary embodiment is presented and described, and all variations and modifications that presently and in the future lie within the protective scope of the invention should be protected.

We claim as our invention:

1. An electrographic printing device, comprising:

a plurality of printing groups each having a respective plurality of developer stations;

a plurality of toner reservoirs outside of said printing groups and each being connected via a respective toner transport channel with one or more of said developer stations of one or more of said printing groups;

each of the toner reservoirs arranged outside of the printing groups being stored in a respective toner transport unit;

each of the toner reservoirs being provided with a respective first circuit having a memory in which is stored at least a color filled into the respective toner reservoir;

a respective second circuit with a memory associated with each of the respective toner transport units, and in each said respective memory is stored at least the respective toner color filled into the respective stored toner reservoir;

a respective third circuit with a memory provided for each developer station, said respective memory having stored therein at least a toner color filled into said respective developer station; and a main control module that controls work flows in the printing groups and interrogates the respective colors contained in the developer stations and toner reservoirs.

2. An electrographic printing device, comprising:

a plurality of printing groups each having a respective plurality of developer stations;

a plurality of toner reservoirs outside of said printing groups and each being connected via a respective toner transport channel with one or more of said developer stations of one or more of said printing groups;

each of the toner reservoirs arranged outside of the printing groups being stored in a respective toner transport unit;

each of the toner reservoirs being provided with a respective first circuit having a memory in which is stored at least a color filled into the respective toner reservoir;

a respective second circuit with a memory associated with each of the respective toner transport units, and in each said respective memory is stored at least the respective toner color filled into the respective stored toner reservoir;

a respective third circuit with a memory provided for each developer station, said respective memory having stored therein at least a toner color filled into said respective developer station; and at least one toner reservoir is provided within the printing group for addition of toner into the respective developer station, said at least one toner reservoir being connected via an additional toner transport channel with said developer station and being connected via a toner transport channel with at least one of the toner reservoirs arranged outside of the printing group.

3. An electrographic printing device according to claim 1 in which the developer stations of the printing groups are designed such that they can additionally be manually supplied with toner.

4. An electrographic printing device according to claim 1 in which the individual toner transport channels are designed as a suction channel through which toner is drawn into the connected developer station.

5. An electrographic printing device according to claim 1 in which information corresponding to the color is respectively stored in a transponder.

6. An electrographic printing device according to claim 1 in which electrical lines via which information are exchanged between the circuits of the developer stations and the toner reservoirs are respectively associated with the toner transport channels.

7. An electrographic printing device according to claim 1 in which the main control module is connected via a bus with the third circuit of the respective developer stations of the printing groups for monitoring of said developer stations.

8. An electrographic printing device according to claim 1, in which a sub-control module is provided connected via a bus with the first circuit and the second circuit and with the main control module, the sub-control module detecting the colors stored in the circuits of the toner transport units and toner reservoirs and communicates them to the main control module.

9. An electrographic printing device according to claim 8 in which the main control module registers information, delivered by the developer stations and the sub-control module, as to which toner reservoir is connected with which developer station.

10. An electrographic printing device according to claim 1, in which the main control module is designed such that it registers equipment status of the printing groups and toner reservoirs with all possible combinations of connections of toner reservoirs with developer stations.

11. An electrographic printing device according to claim 10 in which the main control module displays the equipment status to an operator on a control panel.

12. An electrographic printing device according to claim 1, in which, using information about the color stored in the circuits of the developer stations and toner reservoirs or toner transport units the main control module establishes whether the respective developer station is connected with a toner that contains the correct color.

13. An electrographic printing device according to claim 1 in which the main control module indicates a color change on a control panel.

14. An electrographic printing device according to claim 1 in which the main control module generates an error signal when, given a color change within a toner transport unit or insertion of a toner reservoir with a different toner color, the components between toner reservoir and developer station via which the previously used toner color has been transported have not been exchanged or cleaned.

15. A method for operation of an electrographic printing device, said printing device having a plurality of printing groups each having a respective plurality of developer stations, a plurality of toner reservoirs outside of said printing groups and each being connected via a respective toner transport channel with one or more of said developer stations of one or more of said printing groups, each of the toner reservoirs arranged outside of the printing groups being stored in a respective toner transport unit, each of the toner reservoirs being provided with a respective first circuit having a memory, a respective second circuit with a memory associated with each of the respective toner transport units, and a respective third circuit with a memory provided for each developer station, comprising the steps of:

storing in each of said respective first circuit memories at least the color filled into the respective toner reservoir;

storing in each of the respective second circuit memories at least the respective toner color filled into the respective stored toner reservoir;

storing in each said respective third circuit memory for each developer station at least a toner color filled into said respective developer station; and providing a main control module, registering with said main control module components used for the toner supply of the printing groups upon activation of the printing device, and controlling with said main control module work flows in the printing groups and interrogating the respective colors contained in the developer stations and toner reservoirs.

16. A method according to claim 15 including the step of inspecting the developer stations with regard to:

which developer station is used in the respective printing group;

which toner color is contained in the respective developer station; and in which manner the respective developer station is supplied with toner.

17. A method according to claim 16 in which, in the step of inspecting of the developer stations, checking whether the toner is added via a toner transport unit arranged outside of the respective printing group or its toner reservoir, or via a toner reservoir arranged in the respective printing group, or whether the toner addition occurs manually.

18. A method according to claim 15, in which, in a further step, checking the toner transport units to the effect of:

how many toner transport units are arranged in the printing device;

which toner colors the toner reservoirs stored in the toner transport units have;

whether the toner transport units are functional; and which toner color is stored in the second circuit.

19. A method according to claim 18 in which, given the functionality of the toner transport units, checking whether:

a toner reservoir is inserted; and the toner transport channel is connected and ready for operation.

20. A method according to claim 15, including the step of furthermore checking:

whether a toner reservoir is present;

whether the content of the toner reservoir is readable;

which toner color is located in the toner reservoir; and whether the toner reservoir is empty.

21. A method according to claim 15 including the step of registering with the main control module the configuration of developer stations, toner transport units and toner reservoirs and establishing and processing the current situation of the toner supply.

22. A method according to claim 21 including the step showing the current configuration on the control panel.

23. A method according to claim 15 including the step of interrogating with the main control module the respective developer station as to how its toner supply is to be executed and setting the toner feed to the developer station depending on the result.

24. A method according to claim 15 including the steps of:

providing a toner transport device controlled by a toner transport manager that transports the toner from the toner reservoirs into the developer stations;

with the developer stations outputting toner requests to the toner supply manager; and with the toner supply manager coordinating the toner requests of the developer stations and allocating the supply permission to the developer stations in clock periods.

25. A method according to claim 24 including the steps of:

providing a suction device that transports toner from the toner reservoirs into the developer stations via negative pressure as a toner transport device;

providing a suction clock manager as a toner supply manager;

with the developer stations outputting suction requests to the suction clock manager; and with the suction clock manager coordinating the suction requests of the developer stations and allocating the suction permission to the developer stations in suction clock periods.

26. A method according to claim 25 including the step of allocating with the suction clock manager the suction clock period to only one developer station at a time.

27. A method according to claim 25 including the step of, given multiple printing groups, with the suction clock manager, allocating the suction clock period to only one developer station per printing group at a time.

28. A method according to claim 25 including the step of, with the suction clock manager, allocating the suction clock period to only one developer station that is not simultaneously conveying toner.

29. A method according to claim 25 including the step of, with the suction clock manager, allocating no suction clock period to a developer station if the suction permission for the same toner reservoir has been allocated to a developer station.

30. A method according to claim 25 including the step of, with the suction clock manager, withdrawing the suction permission from a developer station after a predetermined number of suction clock periods allocated to said developer station.

31. A method according to claim 25 including the steps of:

storing the suction requests of the developer stations in a first FIFO memory in the order of their arrival at the suction clock manager, with the suction clock manager examining the suction requests, in the order of their arrival in the first FIFO memory, as to whether a suction permission can be allocated to them; and allocating the suction permission to a suction request of a developer station to be checked when the suction permission has not already been allocated to any other developer station, and when the developer station to be checked is not transporting toner.

32. A method according to claim 25 including the step of in a developer station to which a suction permission has been allocated, blocking the transport function until the suction cycle has ended.

33. A method according to claim 25 including the step of taking the future toner requirements of a developer station into account in the allocation of a suction permission to said developer station.

34. A method according to claim 25 including the step of taking into account the fill level of the toner in the developer station in the allocation of a suction permission to said developer station.

35. A method according to claim 25 including the step of taking into account the toner concentration in the developer station in the allocation of a suction permission to said developer station.

36. A method according to claim 25 including the step of additionally taking into account whether the development of charge images has priority in the operation of a printing group in the allocation of a suction permission to a developer station.

37. A method according to claim 25 including the step of providing the priority in the allocation of a suction permission according to a rigid criterion.

38. A method according to claim 25 including the steps of examining the priorities of all developer stations presenting a suction request before the allocation of a suction request to a developer station, and allocating the suction request to the developer station that has the greatest importance for maintaining the print operation.

* * * * *